US005505398A

United States Patent [19]

Emmerich

[11] Patent Number: 5,505,398

[45] Date of Patent: Apr. 9, 1996

[54] DEVICE FOR SUPPLYING AND EXCHANGING A PLURALITY OF CABLES

[75] Inventor: Herbert Emmerich, Waiblingen, Germany

[73] Assignee: Fraunhofer Gesellschaft zur Forderung der angewandten Forschung e.V., Munich, Germany

[21] Appl. No.: 39,097

[22] PCT Filed: Oct. 10, 1990

[86] PCT No.: PCT/DE90/00770

§ 371 Date: Jun. 10, 1994

§ 102(e) Date: Jun. 10, 1994

[87] PCT Pub. No.: WO92/07399

PCT Pub. Date: Apr. 30, 1992

[51] Int. Cl.[6] ..... B65H 51/04; B65H 59/10; B21C 47/22

[52] U.S. Cl. ..... 242/360; 242/418; 242/560; 242/564.4; 226/109; 83/650

[58] Field of Search ..... 242/360, 390.9, 242/397.1, 418, 418.1, 564.4, 560; 226/108, 109, 110, 118, 119, 186, 14; 83/25, 83, 102, 164, 436, 648, 650

[56] References Cited

U.S. PATENT DOCUMENTS

| | | | |
|---|---|---|---|
| 3,064,869 | 11/1962 | Cooper | 226/110 |
| 3,338,492 | 8/1967 | Cornell, Jr. | 226/110 |
| 3,694,620 | 9/1972 | Gleason | 226/110 |
| 4,043,494 | 8/1977 | Bickford et al. | 226/109 |
| 4,145,014 | 3/1979 | Chatford et al. | 242/390.9 |
| 4,363,165 | 12/1982 | Suzuki et al. | 29/564.8 |
| 4,632,326 | 12/1986 | Boote et al. | 242/560 X |
| 4,655,107 | 4/1987 | Juergenhake | 83/23 |
| 4,879,934 | 11/1989 | Adlon et al. | 226/109 X |
| 4,917,285 | 4/1990 | Shosie | 242/564.4 X |

FOREIGN PATENT DOCUMENTS

| | | |
|---|---|---|
| 0171508 | 2/1986 | European Pat. Off. . |
| 2437763 | 4/1980 | France . |

*Primary Examiner*—John M. Jillions
*Attorney, Agent, or Firm*—Antonelli, Terry, Stout & Kraus

[57] ABSTRACT

A device for supplying and changing a multiplicity of cables is disclosed having a cable changing and supply unit, which is provided with stationary reels which guide individual cables fed from a cable storage and releasable clamping elements associated with the individual cables, a movable drive unit having a drive reel and a routing tool which can be positioned by a multi-axial positioning unit provided with a length-cutting unit. The cable changing and supply unit is stationary and connected to the routing tool via a flexible tube. An intermediate storage is located between the cable storage and the cable changing and supply unit for the cables which are cut in the routing tool and returned to the cable changing unit by means of a drive reel.

24 Claims, 1 Drawing Sheet

DEVICE FOR SUPPLYING AND EXCHANGING A PLURALITY OF CABLES

DESCRIPTION

1. Technical Field

The present invention relates to a device for supplying and changing plural cables.

2. State of the Art

A device for supplying and changing cables is known from DE-A-37 03 011. In this state of the art device the cable change and supply unit and a routing tool are combined in one unit which is positioned by a multi-axial positioning unit, configured as an industrial robot. The combination of a change and supply unit and a routing tool, in an industrial robot has a relatively large weight. An expensive industrial robot is required for positioning. Moreover, movement by this state of the art device is encumbered because all of the cables always run continually from the cable storage to the hand of the robot. In this way, by way of illustration, the industrial robot cannot execute 360° rotations as this would cause undesirable twisting and tangling of the cables.

U.S. Pat. No. 4,363,165 discloses a so-called "capstan" drive which is provided with a drive reel connected to a drive engine which may be disconnected. The weight and size of this device is even greater than that disclosed in DE-A-37 03 011.

DE-AS 1 299 366 discloses a device in which a feed is provided for each cable. Consequently, this device is not suited for operation with an industrial robot. It is provided with a two-axes positioning unit.

DESCRIPTION OF THE INVENTION

The object of the present invention is to provide a device for supplying and changing a multiplicity of cables, which can be employed in conjunction with a relatively small and therefore economic positioning unit.

An essential element of the present invention is that it is not necessary to position the cable changing and supply unit in conjunction with the actual routing tool by means of a multi-axial positioning unit. An element of the present invention is the stationary placement of the cable changing and supply unit and only positioning the routing tool. In order to ensure the cable is fed to the routing tool in an orderly manner by the cable changing and supply unit following termination of the routing procedure, in any position of both parts of the invention, the cable changing and supply unit is connected to the routing tool via a flexible tube through which a cable is fed to the routing tool from the changing and supply unit and returned. In order not to have to transfer the returned cable back into the cable storage which, by way of example, can be a conventional commercial cable reel, an intermediate storage for the cables cut in the routing tool which are returned to the cable changing unit by means of the drive reel is provided between the cable storage and the cable change unit.

The invention permits trouble-free supplying, routing and subsequently changing of cables.

It is advantageous that the flexible tube connecting the cable changing and supply unit to the actual routing tool is a hose which is flexible enough for varying diameters of cables being fed. In this manner cables with different diameters can be routed with the invention without any danger of a cut cable end being retained in the connecting tube.

Another embodiment of the invention is that the intermediate storage is a coiled stock storage in which, by way of example, the returned cable is free and slack.

A further improvement according to the invention has a straightening unit located between the cable storage and the cable changing and supply unit which has the advantage that when the cable is unrolled from a cable reel it can be fed through the flexible tube without any difficulty.

It is desirable in accordance with the invention that if a monitor unit is provided for monitoring the cable fed in the cable changing and supply unit that the monitor unit measure the feeding of the cable, by way of illustration in a state of the art manner, by determining the number of revolutions turned by the drive or counter reel. Moreover, it is desirable in accordance with the invention that the monitor unit is provided with two spaced light barriers which check whether a cable is present. In this manner the cut cable can be drawn back so far that the end of the cable is positioned between the two light barriers.

The present invention is made more apparent by way of example without the intention of limiting the scope or spirit of the with reference to preferred embodiments described with reference to the drawings as follows.

THE BEST METHOD OF CARRYING OUT THE INVENTION

Figure 1:
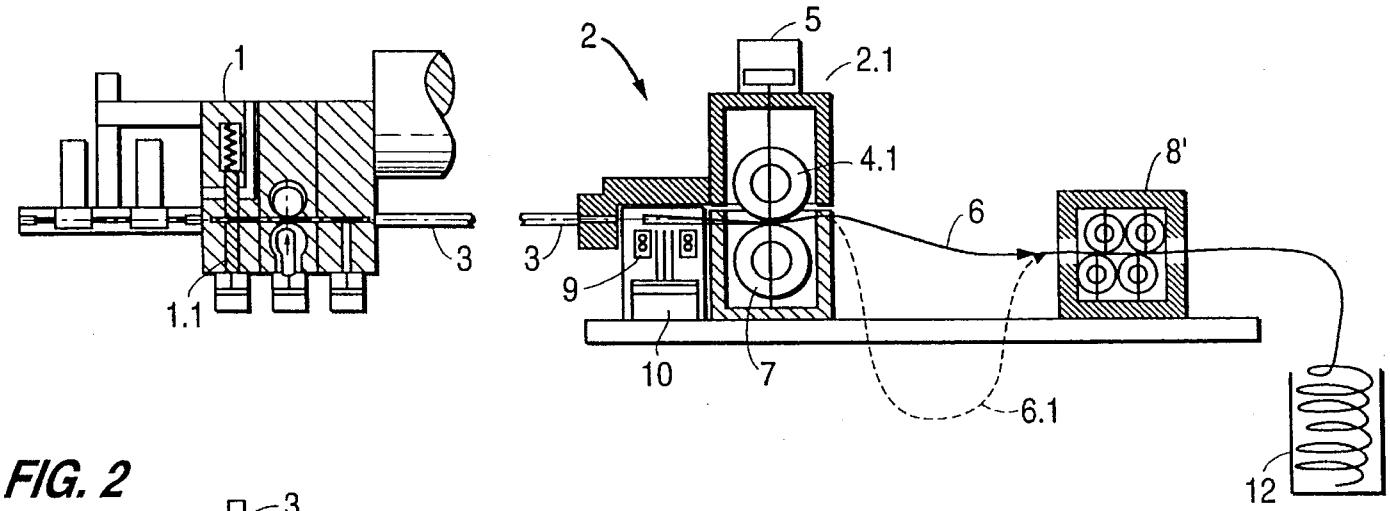
FIG. 1 is a cross section of an embodiment of the invention for supplying and changing a plurality of cables.

FIG. 1 shows a routing tool 1 which can be attached to a multi-axial positioning unit (not illustrated), by way of illustration of an industrial robot, by means of an exchange flange, not depicted in detail, and which is connected to a stationary cable changing and supply unit 2 via a flexible hose 3. In the illustrated preferred embodiment, the routing tool 1 is a contacting tool which is provided, in addition to guide reels and feed reels, with a length cutting, cutting unit 1.1 which, by way of illustration, can be designed according to the length cutting unit described in DE-A-37 03 011.

Figure 2:
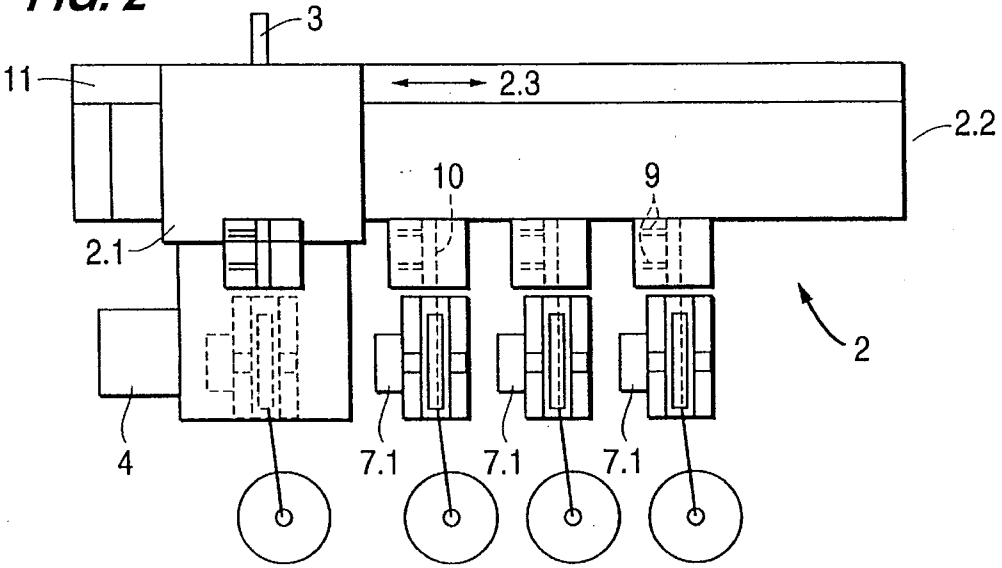
FIG. 2 is a top view of the cable changing and supply unit.

The stationary cable changing and supply unit 2, which is shown in in a top view in FIG. 2, is composed of a basic unit 2.2 on which a drive unit 2.1 can be moved in the direction of an arrow 2.3 cf. FIG. 2 by means of a linear moving unit 11. The drive unit 2.1 is provided with a motor driving drive reel 4.1, which can be applied with the aid of a pneumatic cylinder 5 in direction of the cable 6 to be transported.

In the stationary basic unit 2.2 of the cable changing and supply unit 2, there is a rotating counter reel 7 provided for each cable 6 to be transported. Furthermore, for each cable there are provided two light sensors 9 and a detention mechanism 10. The function of barriers and detention mechanism will be made more apparent below.

Furthermore, in the preferred embodiment of the invention each cable has a straightening unit 8 which has several straightening reels and is disposed between the actual cable changing and supply unit 2 and a cable storage 12 designed by way of ilustration as a cable drum.

How the invention functions is explained in the following manner:

If a cable 6 is routed by contacting tool 1 and another cable is to be routed in the next routing step, first the cable in the tool is cut with the length-cutting unit 1.1 provided therefor. Then the cable is returned in a direction opposite to the normal transport direction by means of the transport device which is formed by the reels 4.1 and 7 by reversing driving of the engine 4. For this purpose the transport reel 4.1 is forced against the cable 6 by the pneumatic cylinder 5. The returned cable 6 forms a loop 6.1 between the cable changing and supply unit 2 and the straightening unit 8 in such a manner that it is stored intermediately for later use.

The return of the cable 6 is controlled first via a rotating reel 7 or via a motor attached to the transport reel 4.1 and secondly via two light sensors 9. As soon as the light sensor 9 disposed on the side of the routing tool 1 is no longer blocked by the drawn back cable 6, the engine 4 is turned off. In this way it is ensured that the cable 6 is no longer in the flexible hose 3 but is completely within the cable changing and supply unit 2. Furthermore, the detention mechanism 10 ensures that the cable cannot slip out of the ready position in the cable changing and supply unit 2.

In order to change a new cable in the routing tool 1, the moveable drive unit 2.1 in conjunction with the motor 4 and the transport reel 4.1 is brought linearly to the ready position of the desired cable with the aid of linear unit 11. After reaching the position, the driven transport reel 4.1 is lowered onto the prepared cable with the aid of the pneumatic cylinder 5. By means of starting the electrical motor 4, the cable is inserted through the hose 3 into the routing tool 1 after releasing the detention mechanism 10. Following the routing procedure a cable changing procedure is carried out as aforedescribed.

The present invention has been made more apparent with reference to a preferred embodiment thereof without the intention of limiting the scope or spirit of the invention, within which there are, of course, many very different modifications possible. In particular, the invention can be designed in such a manner that the control of the industrial robot or a special programmable memory control can be integrated fully automatically into automated cable harness production.

Naturally, modifications to the preferred embodiment may be made. Thus, instead of a linear unit 11 for moving drive unit 4.1, by way of illustration, a rotatory unit may be provided The invention for supplying and changing a multiplicity of cables can be utilized in combination with a relatively small and therefore economical positioning unit.

What is claimed is:

1. A device for supplying and changing a plurality of cables comprising:

a stationary cable changing and supply unit having reels for guiding individual cables fed from a cable storage and a detention mechanism associated with the individual cables, a movable drive unit having a drive reel and a routing tool having a length-cutting unit, an intermediate storage disposed between the cable storage and the cable changing and supply unit for storing cables cut in the routing tool and returned to the cable changing unit by the drive reel and a flexible tube connecting the cable changing and supplying unit and the routing tool through which the individual cables pass.

2. A device according to claim 1 wherein:

the flexible tube is a hose which is flexible for varying diameters of cables which are fed through the tube.

3. A device according to claim 1 wherein:

the intermediate storage is a coiled storage.

4. A device according to claim 2 wherein:

the intermediate storage is a coiled storage.

5. A device according to claim 1 further comprising:

a straightening unit disposed between the cable storage and the cable change and supply unit.

6. A device according to claim 2 further comprising:

a straightening unit disposed between the cable storage and the cable change and supply unit.

7. A device according to claim 3 further comprising:

a straightening unit disposed between the cable storage and the cable change and supply unit.

8. A device according to claim 4 further comprising:

a straightening unit disposed between the cable storage and the cable change and supply unit.

9. A device according to claim 1 further comprising:

a unit for monitoring the feeding of the cable in the cable change and supply unit.

10. A device according to claim 2 further comprising:

a unit for monitoring the feeding of the cable in the cable change and supply unit.

11. A device according to claim 3 further comprising:

a unit for monitoring the feeding of the cable in the cable change and supply unit.

12. A device according to claim 4 further comprising:

a unit for monitoring the feeding of the cable is provided in the cable change and supply unit.

13. A device according to claim 5 further comprising:

a unit for monitoring the feeding of the cable in the cable change and supply unit.

14. A device according to claim 6 further comprising:

a unit for monitoring the feeding of the cable in the cable change and supply unit.

15. A device according to claim 7 further comprising:

a unit for monitoring the feeding of the cable in the cable change and supply unit.

16. A device according to claim 8 further comprising:

a unit for monitoring the feeding of the cable in the cable change and supply unit.

17. A device according to claim 9 wherein:

the unit has two spaced apart light sensors.

18. A device according to claim 10 wherein:

the unit has two spaced apart light sensors.

19. A device according to claim 11 wherein:

the unit has two spaced apart light sensors.

20. A device according to claim 12 wherein:

the unit has two spaced apart light sensors.

21. A device according to claim 13 wherein:

the unit has two spaced apart light sensors.

22. A device according to claim 14 wherein:

the unit has two spaced apart light sensors.

23. A device according to claim 15 wherein:

the unit has two spaced apart light sensors.

24. A device according to claim 16 wherein:

the unit has two spaced apart light sensors.

* * * * *